US006379123B1

(12) United States Patent
Makino et al.

(10) Patent No.: US 6,379,123 B1
(45) Date of Patent: Apr. 30, 2002

(54) CAPACITY CONTROL SCROLL COMPRESSOR

(75) Inventors: Masahiko Makino, Yasu-gun; Akihiko Shimizu, Kusatsu, both of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/423,889

(22) PCT Filed: May 11, 1998

(86) PCT No.: PCT/JP98/02079

§ 371 Date: Feb. 14, 2000

§ 102(e) Date: Feb. 14, 2000

(87) PCT Pub. No.: WO98/51931

PCT Pub. Date: Nov. 19, 1998

(30) Foreign Application Priority Data

May 12, 1997 (JP) ..... 9-120631

(51) Int. Cl.[7] ..... F04B 49/00
(52) U.S. Cl. ..... 417/310; 417/410.5
(58) Field of Search ..... 417/310, 410.5

(56) References Cited

U.S. PATENT DOCUMENTS 4,250,795 A * 2/1981 Martinic ..... 91/445
5,193,987 A 3/1993 Iio
5,236,316 A 8/1993 Iio
5,472,008 A 12/1995 Boarin
5,577,897 A 11/1996 Sasaya
5,639,225 A 6/1997 Matsuda et al.
5,885,063 A * 3/1999 Makino et al. ..... 417/310

FOREIGN PATENT DOCUMENTS

JP 4179886 6/1992
JP 5280476 10/1993
JP 9296787 11/1997

OTHER PUBLICATIONS

Patent Abstracts of Japan vol. 18, No. 059 & JP 05 280467 A dated Oct. 26, 1993.

* cited by examiner

*Primary Examiner*—Charles G. Freay
(74) *Attorney, Agent, or Firm*—Amster, Rothstein & Ebenstein

(57) ABSTRACT

A capacity-controlled scroll compressor having a simple, compact and high-reliability control mechanism, including two pairs of bypass holes (50*a*, 50*b*, 51*a* and 51*b*) each communicating with each of a pair of fluid pockets in the same compression process, a bypass hole (52*a*) communicating with one fluid pocket formed from the pair of fluid pockets aligned as the compression process further proceeds, and a shuttle valve (60) for sequentially opening and closing the bypass holes by reciprocating motion, and fitted into a cylinder (61) disposed inside a fixed end plate (1*a*). The shuttle valve (60) has a stepped cylindrical structure having different outer diameters so as to improve the strength and rigidity of the shuttle valve itself. The smooth operation of the shuttle valve (60) can be ensured even at high temperatures and high pressures.

12 Claims, 6 Drawing Sheets

CAPACITY CONTROL SCROLL COMPRESSOR

FIELD OF THE INVENTION

The present invention relates to a capacity control mechanism for a scroll compressor to be employed in automobile air-conditioning apparatus.

BACKGROUND OF THE INVENTION

As a capacity-controlled type scroll compressor having a valve mechanism for opening and closing a bypass hole, there has been a configuration as disclosed in Japanese Laid-Open Patent Application No. Hei 4-179886, for example, in which a bypass hole is defined on an end plate of a fixed scroll, and a capacity control block incorporating a bypass passage enabling the bypass hole to communicate with a suction chamber formed inside the housing and a valve mechanism for opening and closing the bypass passage is constituted as a unit separate from the fixed scroll.

As another example, there is a system as disclosed in Japanese Laid-Open Patent Application No. Hei 5-280476, in which a cylinder is provided in a fixed scroll member, into which a plunger which is capable of sequentially closing a group of bypass holes communicating between the cylinder and the compression chamber is inserted.

However, in the above described prior art structure, as a gap is formed between the plunger (shuttle valve) and the cylinder wall, a bypass gas from a bypass hole communicating with a fluid pocket on the upstream side flows back from the gap to a fluid pocket on the downstream side through a bypass hole on the downstream side, it suffered a problem of an increase in the driving force and a decrease in the refrigerating capacity.

In addition, during a high-speed high-load operation, as the interior of the cylinder is in a state of high temperature and high pressure by the influence of the bypass gas, it also suffered a problem of deformation of the shuttle valve, which impedes smooth motion of opening and closing.

DISCLOSURE OF THE INVENTION

The present invention addresses the above described prior art problems and aims at providing a high-reliability capacity-controlled scroll compressor in which the discharge capacity can be smoothly changed with a simple and compact structure.

In achieving this purpose the present invention employs as the shuttle valve a stepped cylindrical or columnar configuration with at least two different circular cross sections. With this structure, it is possible to configure a bypass gas passage from each of the bypass holes communicating with fluid pockets as respective independent communicating passages via different stepped cylindrical or columnar portions of the shuttle valve. Also, by employing a stepped configuration for the shuttle valve, strength and rigidity of the shuttle valve itself can be enhanced and thus deformation due to pressure or heat can be prevented. Furthermore, by making the passages independent, back flow from the upstream side to the downstream side can be prevented thus increasing the compression efficiency.

In other words, the invention as described in Claim 1 is one in which the shuttle valve is of a stepped cylindrical or columnar configuration having different outer diameters so as to prevent the deformation of the shuttle valve itself by increasing the strength and rigidity. The invention as described in Claim 2 is one in which the strength and rigidity of the shuttle valve is further enhanced and the machinability improved by making the stepped portion of the shuttle valve tapered.

By employing this structure, a smooth operation of the shuttle valve is possible even inside a high-temperature, high-pressure cylinder during a high-load operation, and a capacity-controlled operation with a good response can be assured over a range from a maximum capacity operation to a minimum capacity operation.

The invention as described in Claim 3 is one in which a ring groove is provided on the outer peripheral surface of the shuttle valve so that a sealing member can be fitted.

By employing this structure, as a compression gas from a bypass hole communicating with a fluid pocket on the upstream side can be completely returned to a suction chamber without flowing back into a bypass hole communicating with a fluid pocket on the downstream side by flowing down the gap between the cylinder and the shuttle valve, pressure loss is minimized and capacity-controlled operation with a high control efficiency can be assured.

The invention as described in Claim 4 is one in which the shuttle valve is of a hollow structure so as to be formed by forging enabling to attain enhanced strength and lower cost.

Also, the invention as described in Claim 5 is one in which a spring guide is formed on an end of the shuttle valve so as to prevent buckling of the spring supporting the shuttle valve.

DESCRIPTION OF PREFERRED EMBODIMENTS

Referring now to drawings, a description of the basic construction of exemplary embodiments of the present invention will be given.

First Exemplary Embodiment

Figure 1:
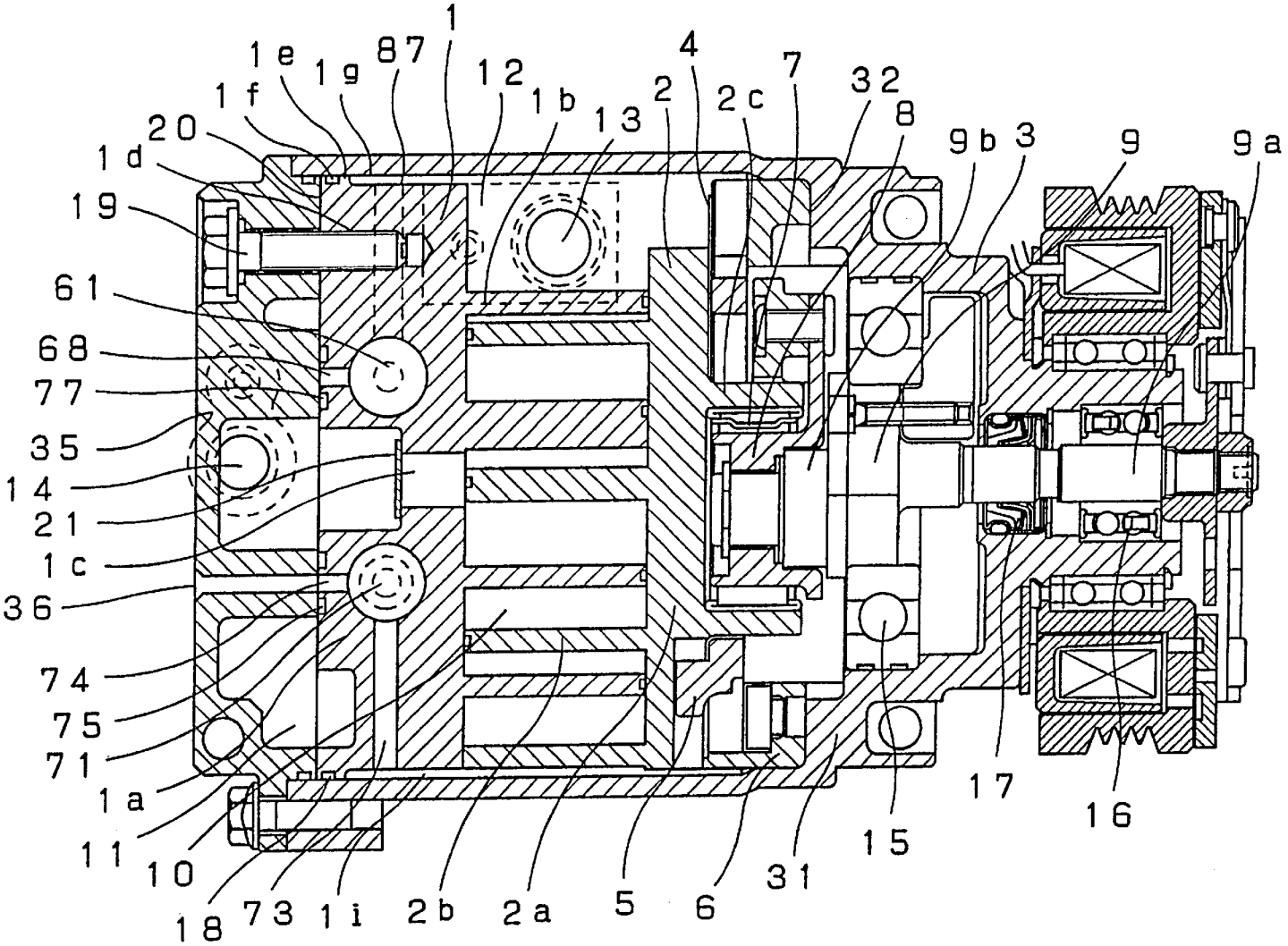
FIG. 1 is a partially in phantom sectional view of a capacity-controlled scroll compressor in an exemplary embodiment of the present invention.

In FIG. 1, a compressor housing 3 is divided into a front housing 31 and a rear plate 5, and includes therein a fixed scroll 1 having a fixed end plate 1*a* and a spiral lap 1*b* erecting on fixed end plate 1*a*, and an orbiting scroll 2 having an orbiting end plate 2*a* and a spiral lap 2*b* erecting on orbiting end plate 2*a* and engaged with fixed scroll 1 with both laps 1*b* and 2*b* facing inward. As an orbiting mechanism, a cylindrical boss 2*c* is formed on the rear side of orbiting end plate 2*a* opposite spiral lap 2*b* of orbiting scroll 2, and an orbiting bearing 7 is provided on boss 2*c*. A drive shaft 9 is rotatably supported via a main bearing 15 fitted in front housing 31, and a main shaft portion 9*a* projects outside of front housing 31 passing through a shaft sealing device 17 and a subsidiary bearing 16.

A drive pin 9*b* disposed at the end of drive shaft 9 on the orbiting scroll 2 side is coupled with an orbiting bush 8 functioning as a drive transmission mechanism inserted in orbiting bearing 7, and gives an orbiting motion to orbiting scroll 2 by transmitting the driving force from drive shaft 9.

Between orbiting end plate 2*a* and front housing 31, a flat plate thrust bearing 4 for axially supporting a thrust exerted to orbiting scroll 2 in parallel to orbiting end plate 2*a*, and a revolution restraining component 6 for restraining the motion of an Oldham ring 5 which has a function of a rotation restraining component for restraining the rotation of orbiting scroll 2 so as to cause it to make an orbiting motion only along the single direction at right angles to drive shaft 9 are disposed.

An O-ring 18 is inserted in a sealing groove 1*f* on the outer peripheral portion 1*e* of fixed end plate 1*a* of fixed scroll 1 as a sealing member for partitioning the interior of compressor housing 3 into a high pressure chamber 11 and a low pressure chamber 12. Fixed scroll 1 forms high pressure chamber 11 by having a fastening hole 1*d* provided on the rear side of fixed end plate 1*a* and a rear plate 35 having a discharge port 14 fastened with a bolt 19.

Revolution restraining component 6 is secured on a front end portion 32 inside front housing 31 having a suction port 13, and orbiting scroll 2 is pushed by a thrust to revolution restraining component 6 via thrust bearing 4. Front housing 31 is closed by rear plate 35 in the vicinity of the outer circumference of fixed end plate 1*a* of fixed scroll 1 with a thrust clearance adjusting shim 20 interposed.

By the orbiting motion of orbiting scroll 2, a refrigerant is introduced from outside of compressor housing 3 into interior low pressure chamber 12 through suction port 13 and led to the vicinities of the outer peripheries of lap 1*b* and lap 2*b* of respective fixed scroll 1 and orbiting scroll 2.

The refrigerant is then sucked into a fluid pocket 10 enclosed between both laps 1*b* and 2*b* by an orbiting motion of orbiting scroll 2, compressed into a smaller volume as it goes from the outer peripheries of both laps 1*b* and 2*b* toward the center, and is discharged into high pressure chamber 11 through a gas discharge hole 1*c* of fixed end plate 1*a*. A reed valve 21 is fitted on gas discharge hole 1*c* from the side of high pressure chamber 11 to prevent a back flow of the discharged gas.

Figure 2:
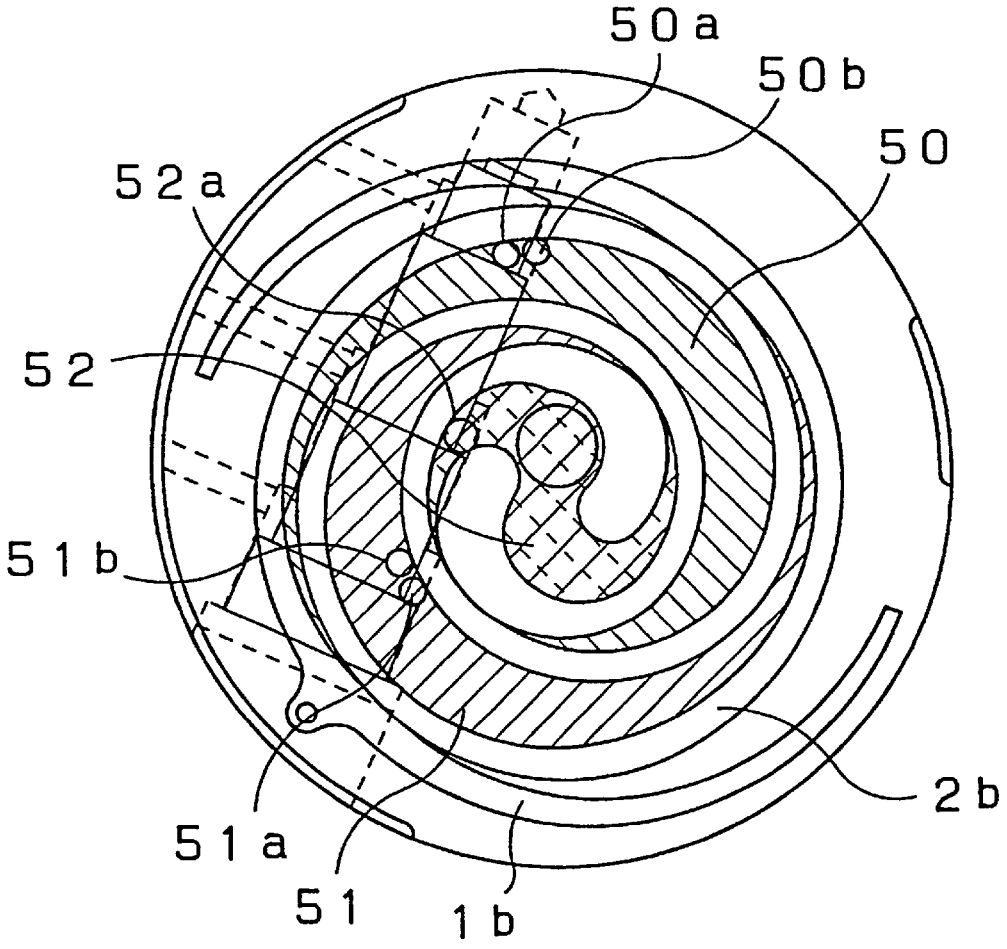
FIG. 2 is a partially in phantom sectional view of a fixed end plate portion of the compressor.
Figure 3:
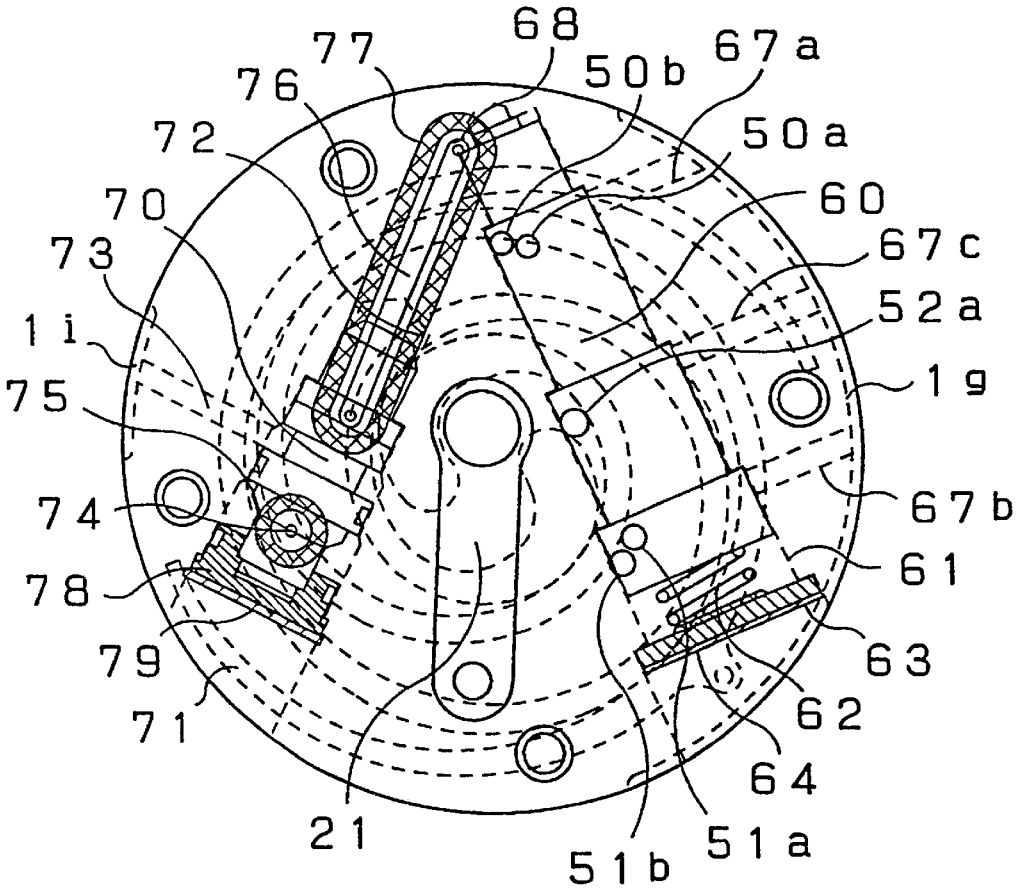
FIG. 3 is a partially in phantom transverse sectional view of a compression chamber of the compressor.

Referring now to FIGS. 2 and 3, construction of the capacity control mechanism will be described.

In fixed end plate 1*a*, two pairs of bypass holes 50*a*, 50*b*, and 51*a*, 51*b*, each pair respectively communicating with each of a pair of fluid pockets 50 and 51 which are in the same compression process, are defined, and a bypass hole 52*a* which communicates with the region in which the pair of fluid pockets merge into one fluid pocket 52 as the compression process further proceeds is defined.

A stepped cylindrical shuttle valve 60 having three different circular cross sections and which sequentially opens bypass holes 50*a*, 50*b*, 51*a*, 51*b* and 52*a* is inserted inside a cylinder 61 provided inside a fixed end plate 1*a* in such a way that it can make a reciprocating motion.

One end of cylinder 61 opens at a cut-away portion 1*g* formed on the outer periphery of fixed end plate 1*a* and communicates with low-pressure chamber 12. Shuttle valve 60 is pushed by a spring 62 in the leading end direction, and one end of spring 62 is held inside fixed end plate 1*a* with a holder 63 and a stop ring 64.

A communicating passage 67*a* which guides a bypass gas from bypass holes 50*a*, 50*b* to cut-away portion 1*g* by opening and closing shuttle valve 60 is provided on cylinder 61. Similarly, a communicating passage 67*b* communicating with bypass holes 51*a* and 51*b* and a communicating passage 67*c* communicating with bypass hole 52*a* are provided.

A lead-in hole 68 is drilled at the leading end of cylinder 61 to allow introduction of a control pressure Pm which makes shuttle valve 60 operable by overcoming the pushing force of spring 62.

On the other hand, a pressure control valve 70 for controlling he control pressure Pm is incorporated in a control-pressure chamber 71 inside fixed end plate 1*a* and is held by a holder 78 and a stop ring 79.

In control-pressure chamber 71, a flow-in hole 72 for taking in an intermediate pressure Pc for generating the control pressure Pm and a flow-out hole 73 are drilled and flow-out hole 73 communicates with low pressure chamber 12 via a cut-away portion 1*i* formed on the outer peripheral portion 1*e* of fixed end plate 1*a*. The flow-out hole 73 also serves as a passage for taking in a suction pressure Ps as a low pressure signal.

Also, a communicating hole 74 for taking in atmospheric pressure Pa to be used as a base signal is drilled on the rear side of fixed end plate 1*a* and is open to the air through a hole 36 drilled on an O-ring 75 and rear plate 35.

Pressure control valve 70 generates an adequate control pressure Pm in response to changes in the intermediate pressure Pc and the suction pressure Ps. The control pressure Pm is transmitted to cylinder 61 through passage 76 formed on the rear side of fixed end plate 1*a* and the earlier-mentioned lead-in hole 68. Passage 76 is sealed with rear plate 35 and an O-ring 77.

Operation of the capacity control mechanism will now be described with reference to FIGS. 4 and 5.

When shuttle valve 60 is at its uppermost position (in the leading end direction of the cylinder), all the bypass holes are fully closed and the operation will be at a maximum capacity. Conversely, when shuttle valve 60 is at its lowermost position (on the holder side), all the bypass holes are fully open and the operation will be at a minimum capacity.

Figure 4:
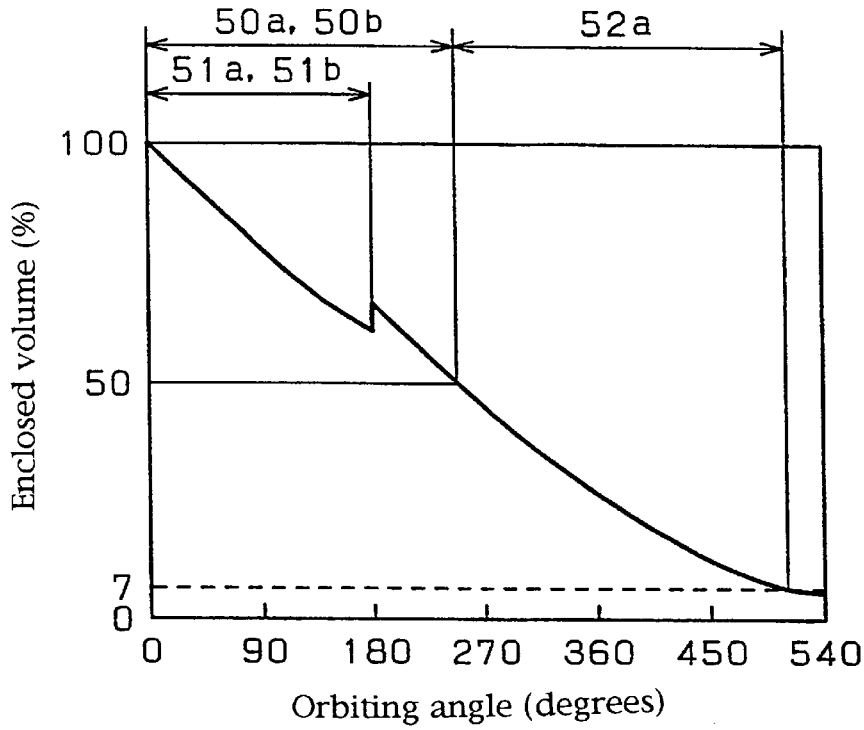
FIG. 4 is a characteristics diagram showing the relationship between the orbiting angle and enclosed volume of the compressor.

As can be seen in FIG. 4, bypass holes 51*a* and 51*b* communicate with the fluid pockets up to 100% to about 60% of the region of the maximum compressed volume Vmax. Likewise, bypass holes 50*a* and 50*b* communicate with 100% to about 50%, and bypass hole 52*a* communicates with about 60% to about 7% of the region.

Figure 5:
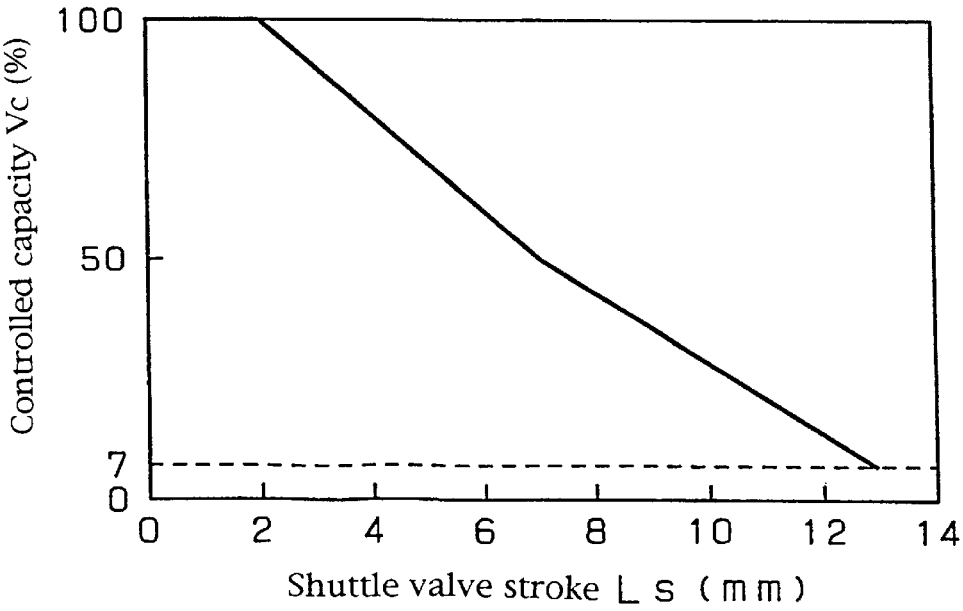
FIG. 5 is a characteristics diagram showing the relationship between the shuttle valve stroke and controlled capacity of the compressor.

By adjusting the openings of these bypass holes with the shuttle valve, the controlled capacity (Vc) vs. shuttle valve stroke (Ls) relationship as shown in FIG. 5 can be obtained.

In FIG. 5, the controlled capacity Vc on the ordinate axis represents percentage ratio of the enclosed volume under control to the maximum enclosed volume of the compressor, and the position of Ls=0 (mm) on the abscissa axis represents a state in which the shuttle valve is at the uppermost position.

In the range from Ls=0 (mm) to Ls=7 (mm), bypass holes 50*a*, 51*a*, 50*b*, and 51*b* are opened sequentially and a capacity control range up to about 50% is covered.

Beyond Ls=7 (mm), bypass hole 52*a* opens sequentially and when shuttle valve 60 reaches the lowermost position [Ls=13 (mm)], the operation will be at about 7% of the capacity.

As has been described earlier, each of the bypass holes has an independent bypass passage thus preventing back flow of a bypass gas into bypass holes on the downstream side thereby enabling capacity control without reducing the control efficiency.

Next, a description of the operation of shuttle valve 60 will be given by using the following symbols:

spring constant of spring 62: k;

initial flection of spring 62: X0;

maximum stroke of shuttle valve 60: X1 (=13 mm); and cross-sectional area of cylinder 61: Sv.

The forces acting on shuttle valve 60 can be obtained by the following equations.

The force Fp with which control pressure Pm moves shuttle valve 60 downward is:

$$Fp=(Pm-Ps)\times Sv.$$

The force Fs with which spring 62 moves shuttle valve 60 upward is:

$$Fs=k\times(X0+X1-Ls).$$

From the above equations, the spring force Fs0 acting on shuttle valve 60 when shuttle valve 60 is at the uppermost position (Ls=0) is calculated to be:

$$Fs0=k\times X0.$$

The spring force Fs1 acting on shuttle valve 60 when shuttle valve 60 is at the lowermost position (Ls=X1) is calculated to be:

$$Fs1=k\times(X0+X1).$$

Consequently, at the time of operation at the maximum capacity, Fp Fs0 holds and shuttle valve 60 is at the uppermost position, whereas at the time of operation at the minimum capacity, Fp Fs1 holds and shuttle valve 60 is at the lowermost position. Also, at the time of controlled capacity operation, Fp=Fs holds, and shuttle valve 60 is balanced at an intermediate position.

Figure 6:
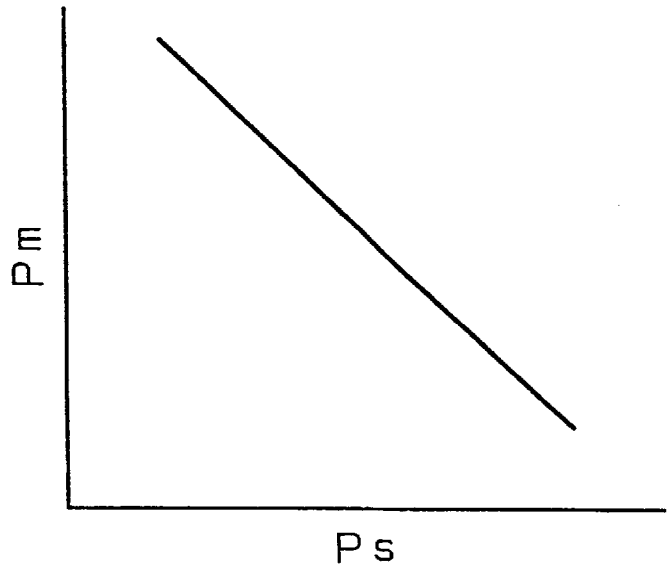
FIG. 6 is a pressure characteristics diagram of the pressure control valve of the compressor.

The pressure characteristics (Pm vs. Ps characteristics) of pressure control valve 70 of the compressor of an exemplary embodiment of the present invention are designed as illustrated in FIG. 6.

When the cooling load is high the suction pressure Ps rises accompanying a drop in the control pressure Pm. In other words, Fp Fs0 holds and shuttle valve 60 is pushed up to the uppermost position causing a maximum capacity operation thus increasing the cooling capacity.

Conversely, when the cooling load is low, the suction pressure Ps drops accompanying a rise in the control pressure Pm. In other words, Fp Fs1 holds and shuttle valve 60 is pushed down to the lowermost position causing a minimum capacity operation thus decreasing the cooling capacity.

The range of Fs1>Ps>Fs0 (kgf/cm$^2$) is a range of controlled operation where the control mechanism works so as to stabilize the suction pressure Ps at an optimum value in accordance with the cooling load.

In the above structure, as the shuttle valve 60 is of a stepped cylindrical configuration with different outer diameters, the rigidity against axial bending is higher compared to prior art single cylindrical configuration. As a result, when shuttle valve 60 reciprocates inside cylinder 61 depending on the cooling load, the clearance is maintained constant allowing a controlled operation with a superior response.

Second Exemplary Embodiment

Figure 7:
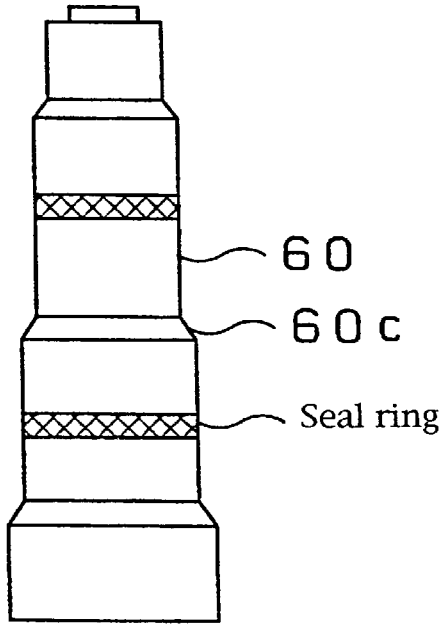
FIG. 7 is a diagram showing structure of a tapered stepped shuttle valve in second exemplary embodiment of the compressor.

FIG. 7 illustrates a shuttle valve 60 with a step portion 60*c* connecting steps tapered. With this, not only the strength and rigidity of shuttle valve 60 are further enhanced but the wear of the cylinder wall surface owing to the edges of step portion 60*c* is also prevented, thus improving the operability. Here, tapering of step portion 60*c* may be of a degree made by chamfering.

Third Exemplary Embodiment

Figure 8:
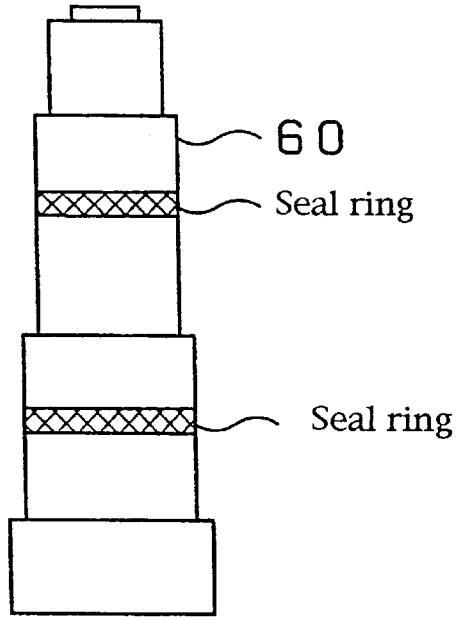
FIG. 8 is a diagram showing structure of a shuttle valve having a seal ring in third exemplary example of of the compressor.

FIG. 8 is an illustration of a shuttle valve 60 provided with ring grooves on the outer peripheral surface and fitted with seal rings made of PTFE.

In this embodiment, it is possible to prevent back flow of a bypass gas from bypass hole 52*a* to bypass holes 50*a*, 50*b*, and 51*a*, 51*b*, thereby improving control efficiency by completely bypassing a compression gas to the low pressure side.

Fourth Exemplary Embodiment

By machining only the external surface, the surface being sliding surface, after forging shuttle valve 60 into a hollow structure, the processing time can be shortened and the machining cost reduced, and a higher strength than that of an article in which the entire surface is machined can be obtained.

Fifth Exemplary Embodiment

As has been described in the description of the first exemplary embodiment, as the compressor in accordance with the present invention has a sufficiently long axial dimension of shuttle valve 60 relative to the radial dimension owing to its simple structure, buckling of spring 62 supporting shuttle valve 60 is easy to take place.

Figure 9:
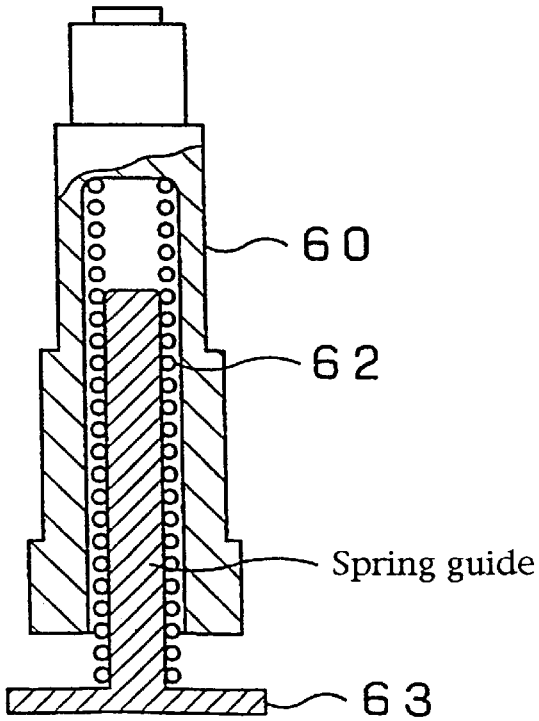
FIG. 9 is a partially cut-away view of a shuttle valve having a spring guide in fifth example of an embodiment of the compressor.

In this embodiment, the above-mentioned shortcomings can be prevented by providing a spring guide portion on the end of shuttle valve 60 as illustrated in FIG. 9.

INDUSTRIAL APPLICATION

As is clear from the above exemplary embodiments, in the capacity-controlled scroll compressor in accordance with the present invention, it is possible to enhance strength and rigidity of the shuttle valve by employing a stepped cylindrical or columnar configuration having different outer diameters. Specially, strength and operability of the shuttle valve can be further improved by tapering the step portion.

Also, as ring grooves are provided on the outer peripheral surface of the shuttle valve for fitting a sealing member, capacity-controlled operation at a high control efficiency can be effected.

By forming the shuttle valve by forging into a hollow structure, it is also possible to attain a high strength and low cost.

Furthermore, by forming a spring guide portion in the shuttle valve, it is possible to prevent deformation due to buckling of the spring.

As set forth above, the present invention provides a capacity-controlled scroll compressor having a simple construction and high reliability.

LIST OF REFERENCE NUMERALS

1. Fixed scroll
1*a*. Fixed end plate
1*b*. Spiral lap of fixed scroll
1*c*. Discharge hole
1*d*. Fastening hole
1*e*. Outer periphery of fixed end plate
1*f*. Sealing groove
1*g*, 1*i*. Cut-away portion of fixed end plate outer periphery

2. Orbiting scroll
2*a*. Orbiting end plate
2*b*. Spiral lap of orbiting scroll
2*c*. Boss
3. Compressor housing
4. Thrust bearing
5. Oldham ring
6. Revolution restraining component
7. Orbiting bearing
8. Orbiting bush
9. Drive shaft
9*a*. Main shaft portion
9*b*. Drive pin
10, 50, 51, 52. Fluid pockets
11. High pressure chamber
12. Low pressure chamber
13. Suction port
14. Discharge port
15. Main bearing
16. Subsidiary bearing
17. Shaft sealing device
18, 75, 77. O-rings
19. Bolt
20. Adjusting shim
21. Reed valve
31. Front housing
32. Front end portion
35. Rear plate
36. Hole
50*a*, 50*b*, 51*a*, 51*b*, 52*a*. Bypass Holes
60. Shuttle valve
60*c*. Step portion
61. Cylinder
62. Spring
63, 78. Holders
64, 79. Stop rings
67*a*, 67*b*, 67*c*. Communicating passages
68. Lead-in hole
70. Pressure control valve
71. Control-pressure chamber
72. Flow-in hole
73. Flow-out hole
74. Communicating hole
75, 77. O-rings
76 Passage

What is claimed is:

1. A capacity-controlled scroll compressor including in a compressor housing thereof:

a fixed scroll having a fixed end plate and a spiral lap erecting from the fixed end plate;

an orbiting scroll having an orbiting end plate and a spiral lap erecting from said orbiting end plate and disposed in engagement with said fixed scroll with respective laps facing each other;

an orbiting mechanism formed on the rear side of said orbiting end plate opposite the spiral lap of said orbiting scroll;

a flat plate thrust bearing for axially supporting a thrust exerted to said orbiting scroll; and a drive shaft rotatably supported in said compressor housing with the main shaft portion thereof projecting to outside of said compressor housing passing through a shaft sealing device and a subsidiary bearing through a main bearing;

and comprising;

a drive transmission mechanism for transmitting the driving force from said drive shaft to said orbiting mechanism;

a rotation restraining component for restraining rotation of said orbiting scroll so as to make it orbit;

a revolution restraining component adjacent to said rotation restraining component for restraining the direction of motion of said rotation restraining component to the direction at right angles to said drive shaft;

at least a pair of bypass holes communicating with a fluid pocket formed in between both laps by the orbiting motion of said orbiting scroll and provided at positions symmetrical with respect to said fluid pocket;

a cylinder formed inside said fixed end plate in a manner communicating with said fluid pockets through said bypass holes; and a shuttle valve which can reciprocate inside said cylinder; and performing compression from the outer periphery of said both laps toward the center and the discharge capacity is made to continuously change by sequentially opening and closing said bypass holes by said shuttle valve, wherein said shuttle valve has a stepped or columnar structure having at least two different circular cross sections; and the portion connecting said steps of said stepped portion of said shuttle valve is tapered.

2. The capacity-controlled scroll compressor of claim 1, wherein said shuttle valve is provided with at least one ring groove for fitting a ring-shaped sealing member.

3. The capacity-controlled scroll compressor of claim 1, wherein said shuttle valve is formed by forging into a hollow structure.

4. The capacity-controlled scroll compressor of claim 1, wherein a spring guide portion is provided on an end portion of said shuttle valve extending axially into said shuttle valve.

5. A capacity-controlled scroll compressor including in a compressor housing thereof:

a fixed scroll having a fixed end plate and a spiral lap erecting from the fixed end plate;

an orbiting scroll having an orbiting end plate and a spiral lap erecting from said orbiting end plate and disposed in engagement with said fixed scroll with respective laps facing each other to define a plurality of fluid compression pockets and positioned to receive fluid to be compressed from a suction chamber in said housing;

an orbiting mechanism formed on the rear side of said orbiting end plate opposite the spiral lap of said orbiting scroll; and a drive shaft rotatably supported in said compressor housing with the main shaft portion thereof projecting to the outside of said compressor housing passing through a shaft sealing device and a subsidiary bearing through a main bearing;

and comprising:

a drive transmission mechanism for transmitting the driving force from said drive shaft to said orbiting mechanism;

a rotation restraining component for restraining rotation of said orbiting scroll so as to make it orbit;

a revolution restraining component adjacent to said rotation-restraining component for restraining the direction of motion of said rotation restraining component to the direction at right angles to said drive shaft;

at least a pair of bypass holes communicating with at least two of said fluid compression pockets and provided at positions symmetrical with respect to said fluid pocket;

a cylinder formed inside said fixed end plate in a manner communicating with said fluid pockets through said bypass holes;

a shuttle valve which can reciprocate inside said cylinder between an open position and a closed position having a stepped or columnar structure with at lease two adjacent cross sections wherein each cross section of said shuttle valve opens and closes a different fluid pocket; and a first communication passage in said fixed end plate associated with a first of said at least two different cross sections of said shuttle valve communicating between one of said fluid pockets and said suction chamber when said shuttle valve is in an open position.

6. The capacity-controlled scroll compressor of claim 5 further including a second communication passage in said fixed end plate associated with a second of said at least two different cross sections communicating between a second of said fluid pockets and said suction chamber when said shuttle valve is in an open position.

7. The capacity-controlled scroll compressor of claim 5 further including a separate communication passage in said fixed plate associated with each of said different cross sections of said shuttle valve wherein each separate passage communicates between a separate one of the said fluid pockets and said suction chamber when said shuttle valve is in an open position.

8. The capacity-controlled scroll compressor of claim 6 wherein the portion connecting steps of the stepped portion of said shuttle is tapered.

9. The capacity-controlled scroll compressor of claim 6 wherein said shuttle valve is provided with at least one ring groove for fitting a ring-shaped sealing member between a first and a second cross section.

10. A capacity-controlled scroll compressor including in a compressor housing thereof;

a fixed scroll having a fixed end plate and a spiral lap erecting from the fixed end plate;

an orbiting scroll having an orbiting end plate and a spiral lap erecting from said orbiting end plate and disposed in engagement with said fixed scroll with respective laps facing each other;

an orbiting mechanism formed on the rear side of said orbiting end plate opposite the spiral lap of said orbiting scroll;

a flat plate thrust bearing for axially supporting a thrust exerted to said orbiting scroll; and a drive shaft rotatably supported in said compressor housing with the main shaft portion thereof projecting to outside of said compressor housing passing through a shaft sealing device and a subsidiary bearing through a main bearing;

and comprising;

a drive transmission mechanism for transmitting the driving force from said drive shaft to said orbiting mechanism;

a rotation restraining component for restraining rotation of said orbiting scroll so as to make it orbit;

a revolution restraining component adjacent to said rotation restraining component for restraining the direction of motion of said rotation restraining component to the direction at right angles to said drive shaft;

at least a pair of bypass holes communicating with a fluid pocket formed in between both laps by the orbiting motion of said orbiting scroll and provided at positions symmetrical with respect to said fluid pocket;

a cylinder formed inside said fixed end plate in a manner communicating with said fluid pockets through said bypass holes; and a shuttle valve which can reciprocate inside said cylinder; and performing compression from the outer periphery of said both laps toward the center and the discharge capacity is made to continuously change by sequentially opening and closing said bypass holes by said shuttle valve, wherein said shuttle valve has a stepped or columnar structure having at least two different circular cross sections and is formed by forging into a hollow structure.

11. The capacity-controlled scroll compressor of claim 10, wherein said shuttle valve is provided with at least one ring groove for fitting a ring-shaped sealing member.

12. The capacity-controlled scroll compressor of claim 10, wherein a spring guide portion is provided on an end portion of said shuttle valve.

* * * * *